United States Patent [19]

Maynor, Jr.

[11] 4,093,969

[45] June 6, 1978

[54] ELECTRIC UMBRELLA

[76] Inventor: Morris Maynor, Jr., P.O. Box 368, Atlanta, Tex. 75551

[21] Appl. No.: 736,347

[22] Filed: Oct. 28, 1976

[51] Int. Cl.[2] ..... H05C 1/06

[52] U.S. Cl. ..... 361/232; 135/33 C; 135/DIG. 10

[58] Field of Search ..... 128/404, 405, 419 S, 128/420; 135/DIG. 10, 33 C; 240/6.42; 361/232

[56] References Cited

U.S. PATENT DOCUMENTS

| | | | |
|---|---|---|---|
| 1,659,346 | 2/1928 | Beatty | 240/6.42 |
| 2,105,172 | 1/1938 | Voelker | 135/33 C |
| 2,966,621 | 12/1960 | Voll | 361/232 |
| 2,981,465 | 4/1961 | Bartel | 361/232 |

FOREIGN PATENT DOCUMENTS

| | | | |
|---|---|---|---|
| 256,744 | 6/1928 | Italy | 361/232 |

*Primary Examiner*—Gerald Goldberg
*Attorney, Agent, or Firm*—Wm. J. Stephenson

[57] ABSTRACT

A conventional umbrella provided with a high powered electric shocking device such as used in cattle probes and the like to provide a disguised but positive weapon for use against muggers and other would be attackers.

11 Claims, 5 Drawing Figures

ELECTRIC UMBRELLA

OBJECT OF THE INVENTION

In recent years, the holdup and mugging of innocent people along the streets and in the hallways of apartments has been on the increase. Often the victim is without any means of defense whatsoever. It is the object of this invention to provide some degree of protection for the public. Such a means is a weapon disguised in the form of a conventional umbrella whereby the prospective attackers suspicions would not be aroused and actually the weapon may be quickly brought into play when an attack is instituted.

Another object of the invention is to disguise a near lethal electrical shocking apparatus in the conventional umbrella.

Another object of this invention is to provide a means whereby the said weapon, i.e., an electric probe disguised as an umbrella, may be prevented from being wrestled from or otherwise removed from the hands of the potential victim. To this end a wrist strap is provided so as to prevent removal of the unit from the grasp of the potential victim without the application of considerable force and an automatic switch is provided which will automatically operate the weapon upon any application of such force.

Another object of this invention is not only to provide a shocking device at the end of a conventional umbrella but to also so design the umbrella so that the shocking force may also be applied to anyone grasping any portion of the umbrella between the end thereof and the handle by shocking elements provided in the umbrella.

Another object of this invention is to provide a cover for said umbrella which will also be electrically connected to the shocking device so as to render the unit effective as a weapon when folded and apparently not in use. This is done by the provision of shocking elements imbedded in said cover so that one grasping the covered unit will receive the full force of the shocking device, when the device is turned on.

IN THE DRAWINGS

FIG. 4 shows the covering provided with spaced electrical shocking contacts which circle the cover from one end to the other when the cover is applied over the umbrella.

FIG. 5 shows an alternate method of providing the shocking contacts in the umbrella cover. In this embodiment the spaced electrical shocking contacts are applied along opposite sides of the covering with accurate branching portions extending around the surface of the cover when the same is applied to the umbrella.

THE INVENTION

Figure 2:
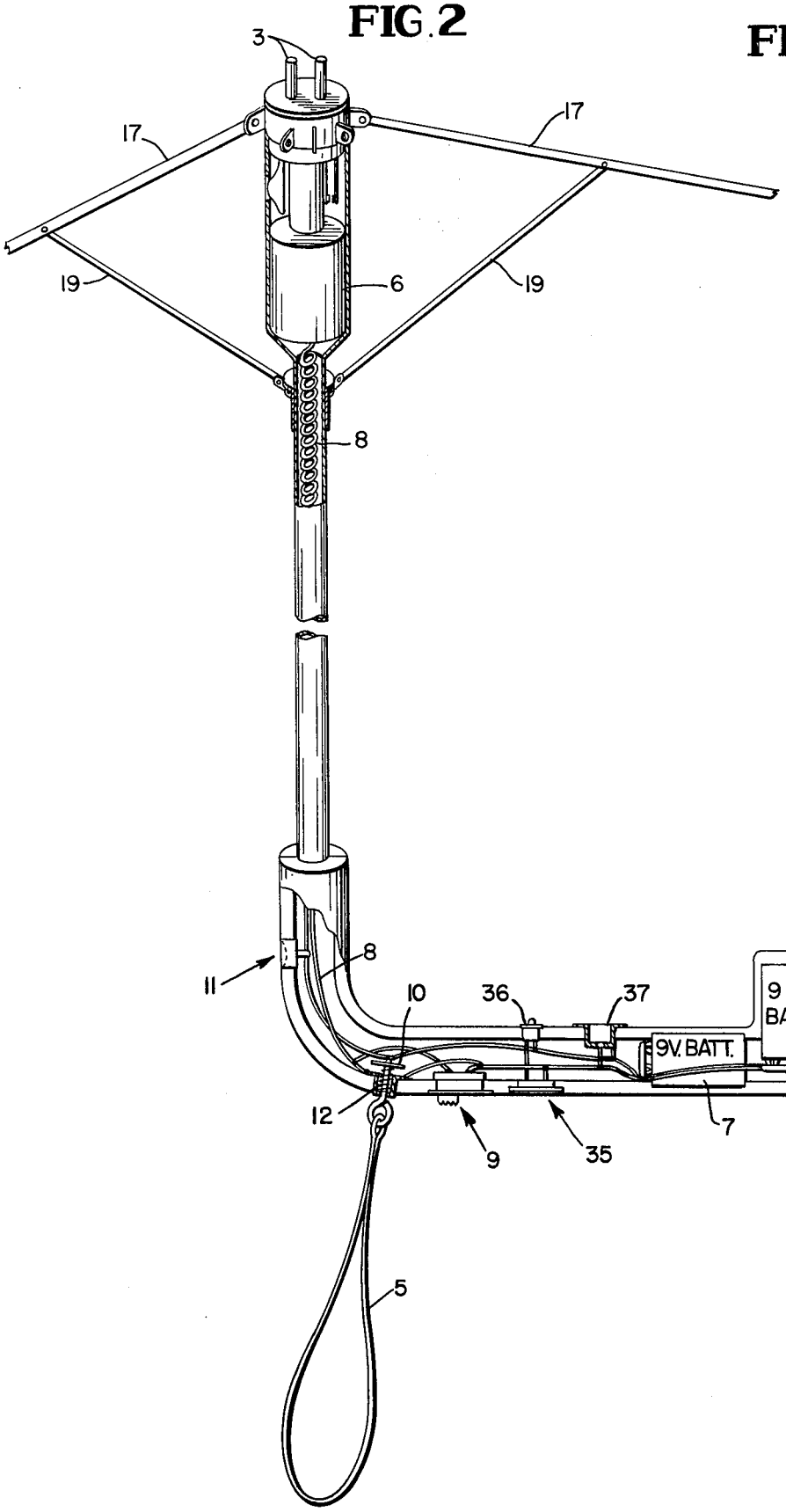
FIG. 2 is a cut away view, partly in section, of the general mechanics of my defense umbrella shown with umbrella in an extended position (the cover of the umbrella is omitted).
Figure 1:
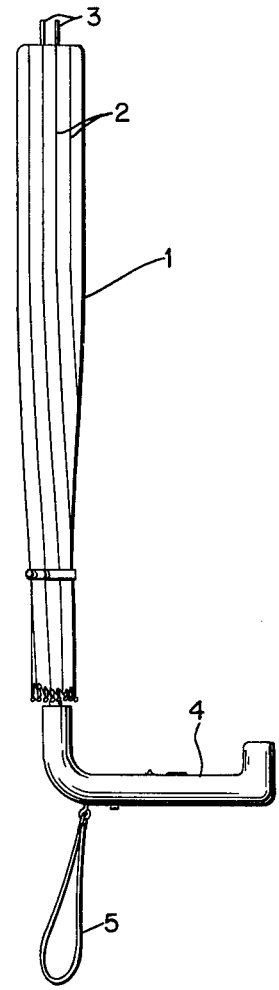
FIG. 1 is a view of the defense umbrella made in accordance with my invention shown in the folded conventional carrying position.

In FIG. 1 I have illustrated my invention as a conventional umbrella which to all intents and purposes is an exact reproduction of a conventional umbrella. However, the single pointed element usually found on the conventional umbrella has been replaced by two prongs projecting from the end thereof. These two prongs are, of course, insulated from each other and form probes or electrical shocking elements. The umbrella itself in FIG. 1 is designated by the reference numeral 1. Numeral 2 shows the conventional staves of the umbrella generally parallel when the umbrella is in a folded position as shown. 3 illustrates the probes or electrical shocking elements extending from the end of the umbrella. 4 illustrates the conventional handle of the umbrella and 5 is a conventional wrist strap. FIG. 2 generally shows the basic construction of my defense umbrella. The shocking device 6 is incorporated in the stem of the umbrella near the extreme end thereof. It is connected by suitable wires 8 to a power source such as conventional batteries 7 enclosed in the handle of the umbrella. These wires 8 are shown in FIG. 2 as coils within the stem of the umbrella so as to provide for movement of the stem relative to the handle should force be applied to the stem the coils thus insuring that the wires shown in the handle portion of the FIG. 2, also as 8, would not be broken should movement between the handle and the stem occur. The shocking device itself is connected to the probes or electrical shocking elements 3 extending from the end of the umbrella. A switch 9 is included in the handle. Said switch is positioned so as to be easily accessible to the hand gripping the handle so that slight finger pressure on the switch will activate the shocking device. A further switch is provided at 10 which is connected to the wrist strap. This switch 10 is normally held in an inoperative position by a spring 12. However, any force applied to the umbrella and to the wrist strap would result in compression of the spring 12 and thereby actuating the switch member 10. Accordingly, the defense weapon may be immediately brought into operation whenever anyone attempts to pull the umbrella from the grasp of the owner; as for example, when the owner may be suddenly attacked and not have his hand in position to operate the finger switch 9. Such attack, i.e., any attempt to wrestle or pull the umbrella from the hands of the owner would immediately apply sufficient force between the wrist strap 5 and the umbrella itself to cause closing of the switch 12 and thus activate the shocking device. A safety device 11 is provided which may be in the form of a conventional rotatable switch which may include a slot or the like in which a coin may be inserted to turn the switch from operative to non-operative position to totally disarm the defense weapon. For example, when the same is to be stored, the defense umbrella would be harmless to children who might be attempting to play with the same or use the same not knowing that it was, in fact, a near lethal weapon which they had their hands on. The disarming device (switch 11) may be so incorporated as to positively disarm the apparatus under all conditions, i.e., to render ineffective both switch 9 and 12 or may be positioned so as to only inactivate hand switch 9 as desired.

Figure 3:
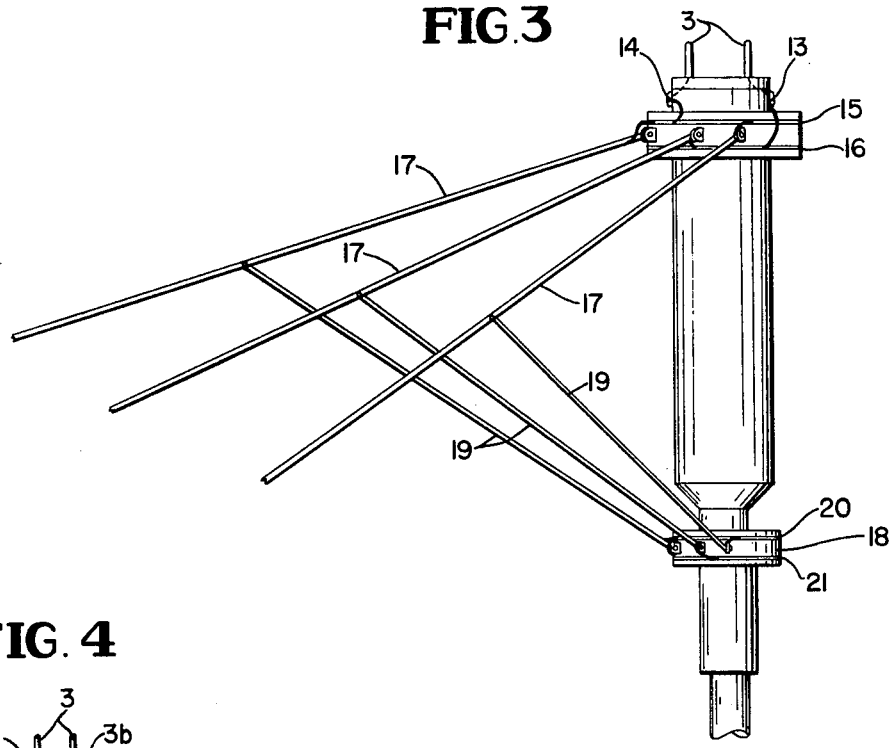
FIG. 3 is a view of the general construction of the umbrella showing how the alternate staves of the umbrella can be connected to the shocking device so that each adjacent pair of staves forms a shocking electrical contact.

All electrical probes or canes have the disadvantage that they may be easily wrestled from the owner by one grasping the body of the probe. In order to overcome this disadvantage, my umbrella may also be provided with shocking contacts extending the full length of the umbrella. The most obvious means of providing such contacts is to incorporate them in the alternate staves of the umbrella itself. One means of providing such incorporation is illustrated in FIG. 3 wherein two insulated rings are provided in the body of the umbrella and the staves themselves are alternately connected to the two rings. When the umbrella is in the folded position as indicated in FIG. 1, the electrical shocking contacts also run the length of the body of the umbrella so that one grasping the same would be subject to shock in some manner were he to contact the exposed probes or shocking elements 3. In FIG. 3 electrical connections 13 and 14 are shown as leading directly from the probes 3 to insulated rings 15 and 16 extending around the end of the umbrella to which staves 17 are attached. As shown in FIG. 3, alternate staves are connected to rings 15 and 16 so as to form a number of shocking contacts which are the equivalent of probes 3. The stave supports 19 connected to movable ring 18 may also be activated if desired by providing contact elements 20 and 21 imbedded in and extending around movable ring 18 and connected to alternate stave supports 19.

Figure 4:
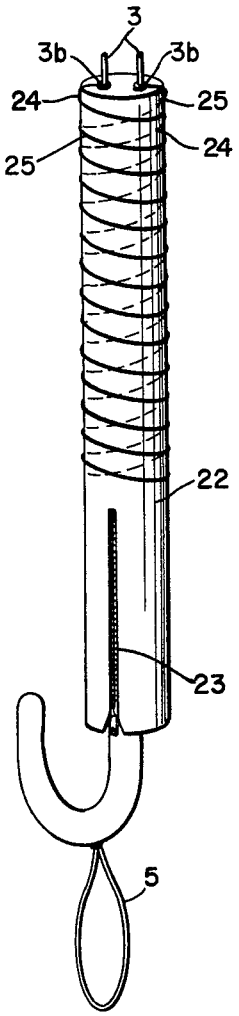
FIG. 4 and FIG. 5 are prospective views of a folded umbrella with a conventional cover applied thereover.
Figure 5:
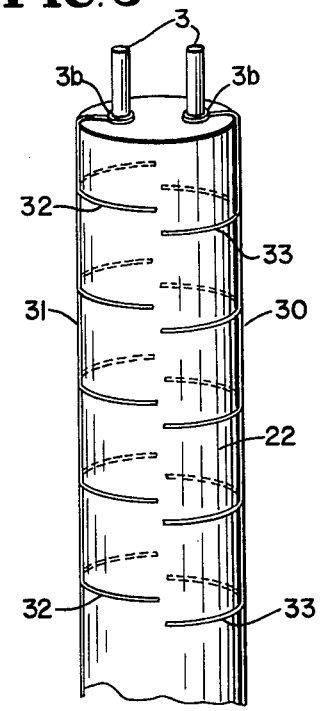

An alternate method of providing electrical shocking contacts or probes extending along the entire body of the umbrella when said umbrella is folded is shown in FIGS. 4 and 5. These embodiments are essentially the same and differ only in the exact pattern of placing the electrical shocking contacts and offer some advantage over the preferred method shown in FIGS. 1 through 3 wherein the umbrella staves themselves provide said electrical contacts or shocking element. In FIGS. 4 and 5, a conventional cover is provided over the folded umbrella. Said conventional cover is generally illustrated at 22 in FIGS. 4 and 5. Reference numeral 23 illustrates a zipper which may be included in one end of the cover to lock the same tightly around the umbrella when the same is folded and the cover placed thereover. In FIG. 4 the end of the cover posseses two holes with metal grommets **3*b* which may be dropped over the probes 3 and form electrical contact therewith. To each grommet is connected one of the conductor wires 24 and 25 which are imbedded in the cover and are wrapped spirally therearound extending the full length of the cover from the probe end down to the locking zipper 23. Thus, when the cover is applied over the umbrella an electrical contact shocking system is provided extending over the entire umbrella. One grabbing the umbrella at any point would naturally cover two or more of the contacts and thereby be subjected to shocking when the weapon was activated. FIG. 5 illustrates another design of the electrical contact shocking system of the umbrella cover. In FIG. 5 two main conductors extend parallel to the body of the umbrella along each side thereof with arcuate branching electrical contact members extending therefrom partially around the surface of the cover. In FIG. 5 the side contacts are illustrated by 30 and 31 with the arcuate electrical contact members 32 and 33** attached thereto.

The covering elements as shown in FIG. 4 and 5 may be used simultaneously with the embodiment shown in FIGS. 1, 2 and 3, constituting an additional contact system or may be used to replace the electrical contact shocking element in the ribs of the umbrella. FIGS. 4 & 5 show two of many possible patterns of imbeding shocking contact in or on umbrella covers.

Where the drawings show the batteries being placed in the handle and the shocking element as being placed in the barrel of the stem of the umbrella it is equally obvious that the entire shocking device including both batteries and shocking elements, i.e., the elements for producing high voltage from low voltage could both be incorporated in the handle or both placed in series within the stem of the umbrella. Smaller A batteries could be used in place of the 9-volt batteries shown in FIG. 1 thus allowing the entire power source to be placed within a rod of relatively small diameter, if so desired. The exact placement of the power source, i.e., batteries and the shocking device, i.e., the transformer for converting low voltage to high voltage, is primarily but a matter of choice so long as their placement does not interfere with the operation of the unit or in any other way affect the disguise of the weapon.

My umbrella may also be provided with a conventional charge meter 35 with a small push button 36 so that any time the user can tell whether his battery is charged. Similar devices are in common use in other battery powered home equipment such as movie cameras. The exact placement of such a charge button would be merely a matter of choice. A common polarized plug for use to recharge the batteries when the umbrella is not in use may be provided as shown at 37 if desired.

Shocking devices in the form of canes or probes have been well known in the art for a number of years but the purpose of such a weapon is obvious and easily seen by any would be attacker and such weapon are ineffective when an assailant grabs the cane or probe along the body thereof. My umbrella will naturally tend to conceal presence of a defense weapon and cannot be grabbed or wrestled away from its owner and moreover may be put to practical use when performing its usual function as an umbrella.

Even before the turn of this century, patents were granted providing an umbrella with electrical devices such as lights or for electrical medical treatments, etc. Examples of such devices are U.S. Pat. No. 639,690 to Sherman for an electrical cane, which also refers to an umbrella, and U.S. Pat. No. 484,618 to Smith also describes that electrical devices may be provided in the handles of umbrellas, crutches, canes or walking sticks but none of these patents refer to the use of such electrical additions as a defensive means to convert the umbrella into a defensive weapon, rather these devices were to furnish medical treatment or serve as an electric light. Electric cattle probes, as earlier stated, have been well known and may even have been supplied in the form of canes. However, such probes or canes make no effort to disguise the offensive nature of the element being carried or to function if contacted at other than its extreme end. To applicant's knowledge, no one has ever made any attempt to provide an electrical umbrella, cane, walking stick or crutch with any safety device which would prevent it from being armed when not desired to be used or insure that it would function as a defensive weapon whenever it was attempted to be taken from its owner. Accordingly, I have designed a useful article which will function as a defense weapon without obviously advertising its presence, which weapon may be inactivated when not desired to be used as such so as to render it completely harmless and which also possesses a means of positive automatic actuation when required.

I claim:

1. In a conventional umbrella to be used as a high powered electric shocking device, including a handle, a stem, a plurality of staves or ribs, a source of electric power, a voltage amplifier, a switch and spaced contact shocking elements incorporated therein; said handle is attached to one end of said stem while said plurality of ribs are commonly connected to the other end of said stem, said spaced contact shocking elements are attached to said other end of said stem and alternate ribs of said plurality of ribs are electrically connected to said shocking elements; in addition, said source of power and said voltage amplifier are placed within the confines of said handle and are connected to each other; said switch is also placed in said handle and is adapted to connect said power source and said shocking elements when correctly activated.

2. The invention of claim 1 wherein said switch includes a spring contact that is activated upon the application of opposing forces between the stem and the handle.

3. The invention of claim 2 wherein the handle possesses a wrist strap whereby the handle and umbrella may be securely fastened to the wrist of the user and thus any force applied to the body of the umbrella will result in actuation of the switch.

4. The invention of claim 3 including an added safety switch for deactivating all other switches in the umbrella.

5. The invention of claim 1 wherein the body of the umbrella is provided with a cover, said cover having spaced contact shocking members extending over the exterior surface thereof and a pair of ring members at the end of said cover member and connected to said spaced contact shocking members, said ring members being designed to slide over the probes or electrical shocking elements in electrical contact therewith.

6. A defense umbrella including a stem member, a handle on said stem member, a ring member on said stem member at an end thereof remote from said handle, rib members pivotly connected to said ring member, an additional ring member slidably mounted on said stem member and connected to said rib members to open and close said ribs, a shocking device included in said stem member, said shocking device consisting of a voltage amplifying element and a source of power, a switch means between said voltage amplifying elements and said source of power, said switch means included in said handle, spaced contact shocking elements extending from the end of said stem member and connected to said shocking device, a wrist strap connected to said switch member by means of a spring member whereby force applied to said wrist strap will actuate said switch member to actuate said shocking device, an additional switch member is provided in said handle, said additional switch member rotatable at 90° to operate the same, said switch member being provided with a slot for the positioning of a coin or the like to provide for the rotation of said additional switch member, said additional switch member being placed between the source of power and the aforesaid switch members so as to disconnect the power source from the shocking device.

7. The invention of claim 6 wherein said first ring member has two insulated ring sections each being electrically connected to one of said spaced contact shocking elements and to alternate ribs of said umbrella.

8. The invention of claim 7 including a conventional cover member positionable over said umbrella when said umbrella is folded, said cover member including spaced contact shocking members extending over the surface thereof and connected to said spaced contact shocking elements when the cover is placed over said umbrella.

9. The invention of claim 6 including a conventional cover member positionable over said umbrella when said umbrella is folded, said cover member including spaced contact shocking members extending over the surface thereof and connected to said spaced contact shocking elements when the cover is placed over said umbrella.

10. The invention of claim 9 wherein the spaced contact shocking means are spiral coils.

11. The invention of claim 9 wherein the spaced contact shocking means are longitudinal elements extending along the sides of the cover with branching members extending laterally therefrom.

* * * * *